United States Patent [19]

Tillbrook

[11] Patent Number: 4,479,268

[45] Date of Patent: Oct. 30, 1984

[54] SPORTMAN'S WATERPROOF SUIT

[76] Inventor: Anthony A. C. Tillbrook, Hillair, Coopersale La., Theydon Garnon, Epping, Essex, England

[21] Appl. No.: 381,559

[22] Filed: May 24, 1982

[30] Foreign Application Priority Data

May 27, 1981 [GB] United Kingdom ..... 8116154

[51] Int. Cl.[3] ..... A62B 17/00

[52] U.S. Cl. ..... 2/2.1 R; 2/170

[58] Field of Search ..... 2/2.1 R, 170

[56] References Cited

U.S. PATENT DOCUMENTS 2,655,663 10/1953 Hoagland ..... 2/170
3,009,164 11/1961 Frey ..... 2/170
3,140,495 7/1964 Gottwik ..... 2/170

FOREIGN PATENT DOCUMENTS 877114 5/1953 Fed. Rep. of Germany ..... 2/170

*Primary Examiner*—Doris L. Troutman
*Attorney, Agent, or Firm*—Wigman & Cohen

[57] ABSTRACT

It is an object of the invention to provide thermal insulation for the hands or feet of aquatic sportsmen such as windsurfers, water skiers, or divers, while, in the case of the hand, allowing a natural grip to be retained. In order to achieve this a glove or foot cover 1 of thin and flexible waterproof material is provided with a wrist or ankle seal 7 which sealingly engages a wrist or ankle seal 6 of a suit 3, such as a dry suit. In order to avoid pressure on the wearer's wrist or ankle, and allow warm air from within the suit to circulate under the glove or foot cover, a band 5 of resilient plastics material is worn over the wrist or ankle and the seals 6 and 7 are stretched over the band.

4 Claims, 1 Drawing Figure

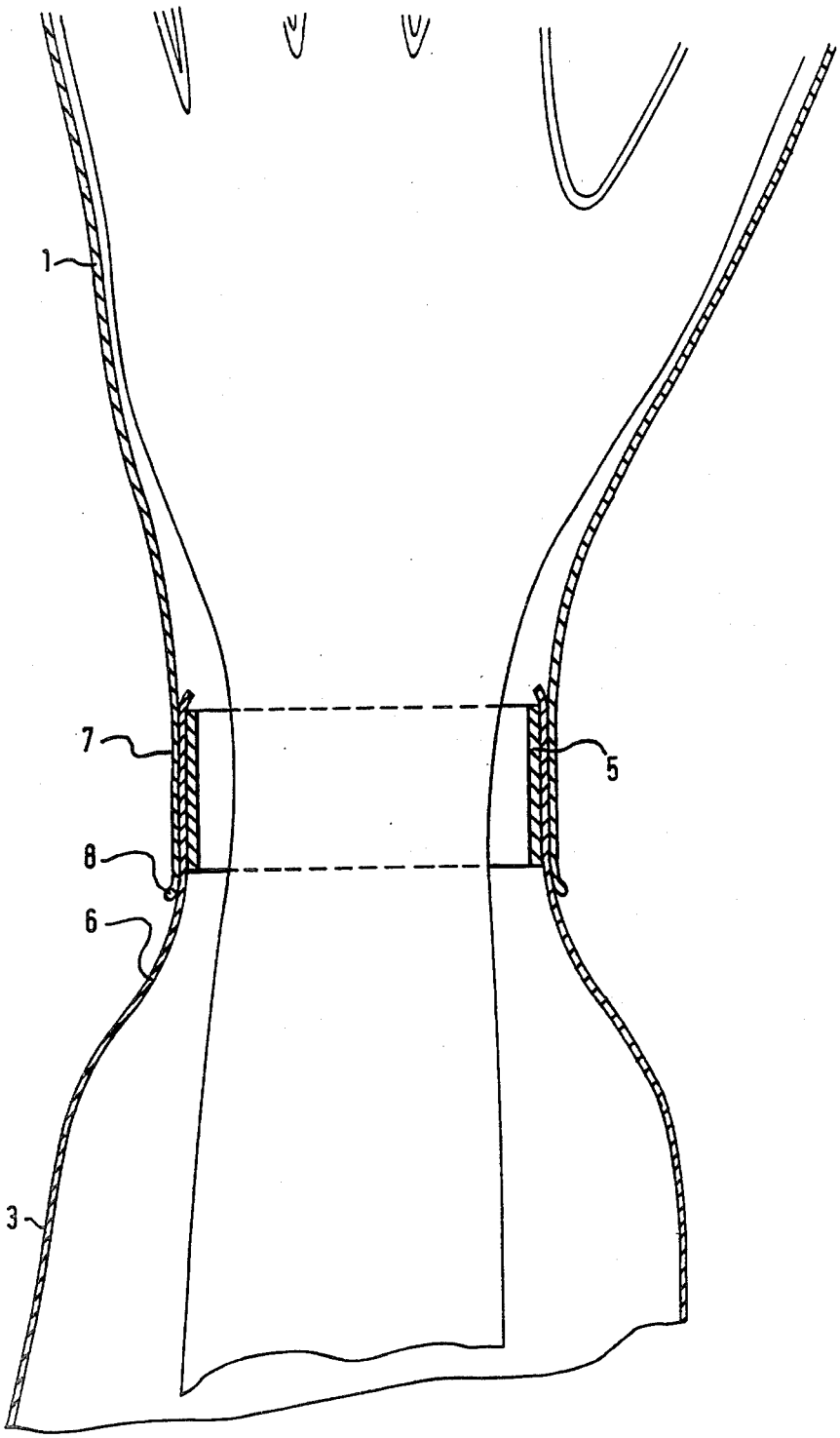
1
7
5
8
6
3

SPORTMAN'S WATERPROOF SUIT

This invention relates to a waterproof suit having an arrangement for providing thermal insulation for the hands and feet, particularly of aquatic sportsmen, such as windsurfers.

While the present invention will be particularly described in relation to problems met by windsurfers, it will be understood that the hand or foot insulation according to the invention is not necessarily limited to use by windsurfers and may for instance by used by other aquatic sportsmen, such as sailors, water skiers or divers. Also, while the problems of hand insulation are particularly important, the construction described may also be used to provide a proper insulation to the feet of aquatic sportsmen.

The commonest form of hand insulation currently available for windsurfers is a glove or mitt made of expanded rubber or rubber like material, normally between 2 mm and 5 mm thick, of closed cell construction and lined on one or both sides with a nylon or other synthetic fabric. From a thermal insulation point of view, such gloves or mitts are satisfactory but the considerable thickness of the material means that the wearer's fingers have difficulty in maintaining a natural grip on the boom of the windsurfing board. This leads to muscular strain and discomfort and a comparatively rapid onset of cramp in the hand and arm so that both pleasure in, and ability at, the sport are lost.

In order to avoid this cramping effect of the expanded rubber gloves, windsurfers may resort to the use of thinner rubber gloves, e.g. of the surgical or household type. However, the thermal insulation is considerably less and also the gloves will let water in if the user falls in the water so that these gloves are of little value when most needed to give insulation against the cold. Wool or cotton inner gloves may be used for thermal insulation, but these would be a serious handicap as they would get very wet on immersion.

Attempts have also been made to provide closed cell expanded rubber or rubber like gloves with leather or like gripping zones, which are thinner and therefore permit a more natural grasp of the boom. However, these are also not waterproof so that their value on immersion is not great.

In accordance with the invention, there is provided a sportsman's waterproof suit having a hand or foot cover manufactured in a thin and flexible waterproof synthetic material and adapted at the wrist or ankle for sealing against a wrist or ankle seal of the waterproof suit to prevent ingress of water at the wrist or ankle, in which spacing means in the form of a substantially rigid cylindrical spacer fitted separately from the cover and suit, and over which both the cover sealing means and the suit wrist or ankle seal are stretched, is provided to present an air passage around the wearer's wrist or ankle to allow air from within the suit to pass into the cover.

The cylindrical spacer may take the form of a split band of resilient plastics material to allow it to expand to admit the wearer's hand or foot and then contract to a loose fit over the wrist or ankle. The edges of the split may be provided with clip means for releasably securing the band in contracted position.

The invention will be further described with reference to the accompanying diagrammatic drawing, of which the sole FIGURE is a sectional view showing a glove in accordance with one form of the invention.

The FIGURE shows a glove 1 moulded or seamed, so as to be waterproof, of a thin flexible and elastic compound such as synthetic rubber, e.g. that known as Latex, which may be lined on one or both sides with a nylon fabric or similar material. The inside layer of such a lining gives the user some direct thermal insulation. However, such lining detracts from the sealing characteristics of the glove so is not present at the sealing surface. A preferred method of manufacture is by dip moulding in a suitable latex, using several coats to form a strong glove.

A preferred form of wrist seal type is shown in the FIGURE. A split cylindrical band 5 of resilient plastics material is put over the wearer's wrist so as to be a loose fit, the split enabling the band to pass over the wearer's hand and then to close by its own resilience. If required the band may have clipping portions to hold the band closed, but this is not always necessary. The wrist seal 6 of a dry suit 3 is then stretched over the band 5 and the wearer then stretches a wrist seal 7 of a glove 1 over the outside of the part of the seal 6 on the band 5. The glove wrist seal 7 is preferably formed by a zone of reducing diameter terminating in an integral bead 8.

It will be seen that there is no pressure on the wrist from either of the seals, which improves the comfort considerably, and therefore helps to eliminate arm cramp so often experienced by windsurfers as a result of anything in contact with the hands from muscle expansion.

A further advantage is that the wrist band improves the quality of the seal, i.e. a wrist seal of a dry suit only is prone to leakage because of irregular skin surface or hairs.

Various modifications may be made within the scope of the invention. Thus a similar seal arrangement may with advantage be used to form a seal between a detachable foot portion and a suit provided with a sealing portion at the ankle.

I claim:

1. A sportsman's waterproof suit having a hand or foot cover manufactured in a thin and flexible waterproof synthetic material and having a seal at the wrist or ankle for sealing against a wrist or ankle seal of the waterproof suit to prevent ingress of water at the wrist or ankle, and spacing means in the form of a substantially rigid cylindrical spacer fitted separately from the cover and suit, and over which both the cover seal and the suit wrist or ankle seal are stretched, the spacing means providing an air passage around the wearer's wrist or ankle to allow air from within the suit to pass into the cover, the wrist or ankle seal of the suit being located directly over the spacing means, and the wrist or ankle seal of the hand or foot cover being located over the spacing means and outside the seal of the suit, the hand or foot cover seal being formed at a terminal area of a zone of reducing diameter of the cover.

2. A suit as claimed in claim 1, in which the cover is moulded in one piece from a rubber or rubber like material.

3. A suit as claimed in claim 1, in which the spacing means is in the form of a split band of resilient plastics material.

4. A suit as claimed in claim 1, in which the zone of reducing diameter of the cover terminates in a bead.

* * * * *